US005343276A

United States Patent [19]

Yamashita et al.

[11] Patent Number: 5,343,276

[45] Date of Patent: Aug. 30, 1994

[54] MANAGEMENT SYSTEM OF IMAGE FORMING APPARATUSES

[75] Inventors: Yuji Yamashita; Masanobu Takahashi; Katsunori Masai; Hiroyuki Inenaka; Masahiro Sako; Yasuhiro Hashimoto; Hideaki Tomita, all of Osaka, Japan

[73] Assignee: Mita Industrial Co., Ltd., Osaka, Japan

[21] Appl. No.: 67,138

[22] Filed: May 26, 1993

[30] Foreign Application Priority Data

May 27, 1992 [JP] Japan ..... 4-162121

[51] Int. Cl.[5] ..... G03G 21/00

[52] U.S. Cl. ..... 355/202; 355/200; 355/203; 355/204; 355/207; 355/208

[58] Field of Search ..... 355/200, 202, 203, 204, 355/205, 206, 207, 208; 371/29.1

[56] References Cited

U.S. PATENT DOCUMENTS

| | | | |
|---|---|---|---|
| 4,167,322 | 9/1979 | Yano et al. | 355/204 X |
| 4,497,037 | 1/1985 | Kato et al. | 355/202 X |
| 4,583,834 | 4/1986 | Sko et al. | 355/206 |
| 5,084,875 | 1/1992 | Weinberger et al. | 355/205 X |
| 5,184,179 | 2/1992 | Tarr et al. | 355/206 |
| 5,212,802 | 5/1993 | Matsumoto | 355/202 X |
| 5,216,461 | 6/1993 | Maekawa et al. | 355/202 |
| 5,220,380 | 1/6993 | Hirata et al. | 355/204 |
| 5,270,775 | 12/1993 | Suzuki | 355/204 |
| 5,282,127 | 1/1994 | Mii | 355/206 X |
| 5,291,420 | 3/1994 | Matsumoto et al. | 355/204 X |

FOREIGN PATENT DOCUMENTS 0142559 8/1984 Japan .

OTHER PUBLICATIONS

*Research Newsletter,* Ritter, Lynn S., "Remote Diagnostics–Tool Kit of the Future", DataQuest Inc., Feb. 1989

*Primary Examiner*—Matthew S. Smith

*Attorney, Agent, or Firm*—Beveridge, DeGrandi, Weilacher & Young

[57] ABSTRACT

A management system of image forming apparatuses according to the present invention includes devices for transmitting information about maintenance of each of a plurality of image forming apparatuses such as copying machines, for example, the number of copies from the image forming apparatus to a centralized management apparatus through transmitting devices, and devices for finding, on the basis of the information about maintenance which is transmitted from the image forming apparatus to the centralized management apparatus, information for efficiently performing the maintenance work, for example, the scheduled date of the maintenance work of the image forming apparatus.

16 Claims, 9 Drawing Sheets

FIG. 2

| ID | K | AK | TKD | TK | D |
|---|---|---|---|---|---|
| 1 | | | | | |
| 2 | | | | | |
| 3 | | | | | |
| ⋮ | | | | | |

FIG. 3

| ID | D | EC |
|---|---|---|
| 4 | April 10 | A (a) |
| 5 | April 12 | B (b) |
| 6 | April 12 | C (d) |
| 8 | April 12 | D (b) |
| 11 | April 12 | B (d) |
| 15 | April 12 | D (c) |
| 20 | April 12 | C (b) |
| 7 | April 13 | A (b) |
| 12 | April 13 | A (c) |
| ⋮ | ⋮ | ⋮ |

FIG. 5

20

| | | | |
|---|---|---|---|
| 6 | 5 | 4 | 3 |
| 7 | 8 | 1 | 2 |
| 10 | 9 | 16 | 15 |
| 11 | 12 | 13 | 14 |

FIG. 6

20

| | | | |
|---|---|---|---|
| 6 ☆ | 5 | 4 | 3 |
| 7 | 8 ☆ | 1 | 2 |
| 10 ☆ | 9 | 16 ☆ | 15 |
| 11 | 12 ☆ | 13 ☆ | 14 |

FIG. 7

20

| | | | |
|---|---|---|---|
| 3 ☆ | 2 | 15 | 14 |
| 4 | 1 ☆ | 16 | 13 |
| 5 ☆ | 8 | 9 ☆ | 12 |
| 6 | 7 ☆ | 10 ☆ | 11 |

FIG. 8

20

| | | | |
|---|---|---|---|
| 3 ☆ | 2 | | |
| 4 | 1 ☆ | | |
| 5 ☆ | 8 | | |
| 6 | 7 ☆ | | |

MANAGEMENT SYSTEM OF IMAGE FORMING APPARATUSES

BACKGROUND OF THE INVENTION

1. Field of the Invention

The present invention relates to a management system of image forming apparatuses such as copying machines.

2. Description of the Prior Art

The maintenance work of a copying machine is generally performed when the number of copies made by the copying machine reaches a predetermined number. Conventionally, information about the number of copies made by a copying machine has been obtained by the visit of a service man to a customer or the contact from the customer. Specifically, the scheduled date of the maintenance work of the copying machine has been determined on the basis of information which can be known when the service man visits the customer or upon request for maintenance from the customer.

The date on which the maintenance work is performed is thus determined on the basis of the information which can be known when the service man visits the customer or upon request for maintenance from the customer. Accordingly, it is difficult to predetermine the scheduled date of the maintenance work, so that the efficiency of the maintenance work is not high.

SUMMARY OF THE INVENTION

An object of the present invention is to provide a management system of image forming apparatuses capable of increasing the efficiency of the maintenance work of an image forming apparatus.

A first management system of image forming apparatuses according to the present invention is characterized comprising means for transmitting information about maintenance of each of a plurality of image forming apparatuses from the image forming apparatus to a centralized management apparatus through transmitting means, and means for finding i.e., calculating or determining, on the basis of the information about maintenance which is transmitted from the image forming apparatus to the centralized management apparatus, information for efficiently performing the maintenance work of the image forming apparatus.

The above described information about maintenance for example, the number of formed images. The above described information for efficiently performing the maintenance work is, for example, the scheduled date of the succeeding maintenance work or the order in which the plurality of image forming apparatuses which are scheduled to be maintained on the same data or on dates close to each other are visited for the maintenance work.

A second management system of image forming apparatuses according to the present invention is characterized by comprising means for transmitting the number of copies made by each of a plurality of copying machines from the copying machine to a centralized management apparatus through transmitting means, and means for finding i.e., calculating or determining, on the basis of the number of copies which is transmitted from the copying machine to the centralized management apparatus, information for efficiently performing the maintenance work of the copying machine.

The above described information for efficiently performing the maintenance work is, for example, the scheduled date of the succeeding maintenance work or the order in which the plurality of copying machines which are scheduled to be maintained on the same date or on dates close to each other are visited for the maintenance work.

A third management system of image forming apparatuses according to the present invention is characterized by comprising means for transmitting the number of copies made by each of a plurality of copying machines from the copying machine to a centralized management apparatus through transmitting means, and means for finding i.e., calculating or determining, on the basis of the number of copies which is transmitted from the copying machine to the centralized management apparatus, the scheduled date of the maintenance work of the copying machine.

The number of copies for a predetermined time period actually made by each of the plurality of copying machines is transmitted from the copying machine to the centralized management apparatus for each predetermined time period. The above described centralized management apparatus comprises storing means having a daily average copy number storage area storing the average number of copies per day, a scheduled total copy number storage area previously storing the scheduled total number of copies made from the time when the maintenance work is performed until the succeeding maintenance work is performed, and a total copy number storage area storing the total number of copies made from the time when the maintenance work is performed up to the present time provided for each copying machine, means for finding, on the basis of the number of copies for the predetermined time period which is transmitted from the copying machine for each predetermined time period, the average number of copies per day made by the copying machine and storing the same in the daily average copy number storage area, means for finding, on the basis of the number of copies for the predetermined time period which is transmitted from the copying machine for each predetermined time period, the total number of copies made from the time when the maintenance work is performed up to the present time by the copying machine and storing the same in the total copy number storage area, means for subtracting the total number of copies which is stored in the total number storage area from the scheduled total number of copies which is stored in the scheduled total copy number storage area for the copying machine, dividing the result of the subtraction by the average number of copies per day which is stored in the daily average copy number storage area to find the difference between the scheduled date of the succeeding maintenance work and the present date, and finding the scheduled date of the succeeding maintenance work on the basis of the difference and the present date, and means for reporting the scheduled date of the succeeding maintenance work found.

Examples of the above described means for reporting the scheduled date of the succeeding maintenance work include a display device, a printing device and the like.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 2 is a schematic diagram showing a part of the contents of a memory device 13;

FIG. 3 is a schematic diagram showing a part of the contents of the memory device 13;

FIG. 5 is a schematic diagram showing a state where small number plates are respectively assigned imaginarily to small blocks in the service area;

FIG. 6 is a schematic diagram showing small blocks in which there exist six customers for which the maintenance work is scheduled to be performed on the same date out of customers in the service area;

FIG. 7 is a schematic diagram showing the position of large number plates after applying a first rule;

FIG. 8 is a schematic diagram showing the position of small number plates in a second large number plate after applying a second rule between a first large number plate and the second large number plate;

DESCRIPTION OF THE PREFERRED EMBODIMENTS

Figure 1:
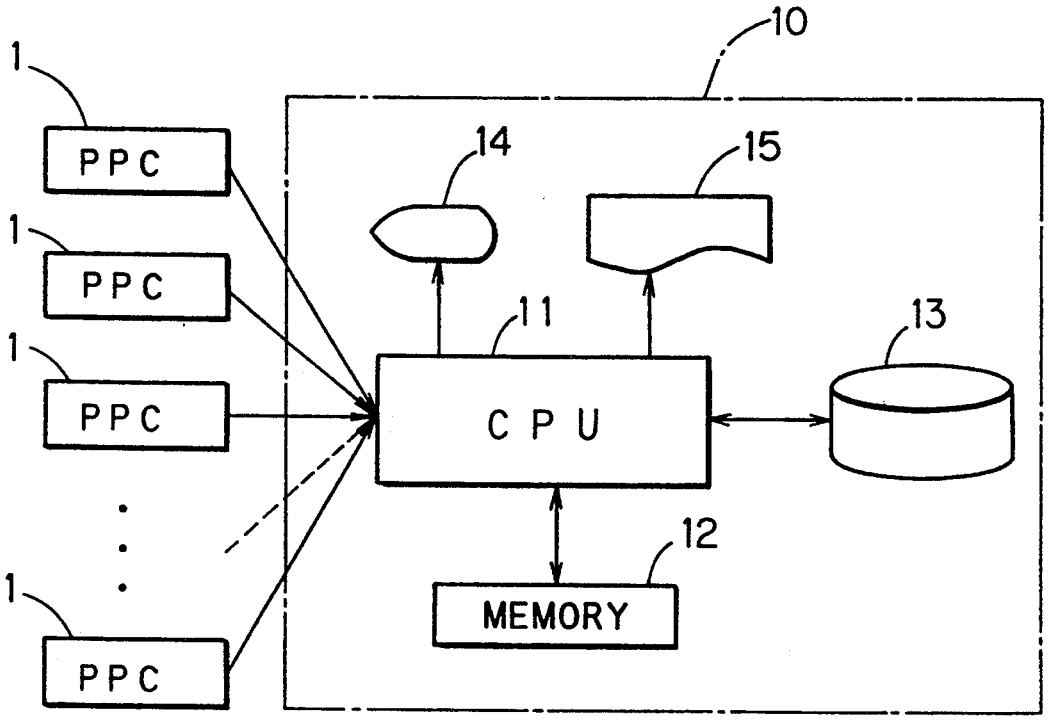
FIG. 1 is an electrical block diagram showing a management system of copying machines.

Referring now to the drawings, description is made of an embodiment in a case where the present invention is applied to a management system of copying machines.

FIG. 1 shows a management system of copying machines.

The management system of copying machines comprises a centralized management apparatus 10 for collecting information about maintenance (hereinafter referred to as maintenance information) from copying machines 1 respectively installed in a plurality of customers and managing the same. The maintenance information is transmitted to the centralized management apparatus 10 from each of the copying machines 1 by wire transmission or wireless transmission.

The centralized management apparatus 10 comprises a memory device 13 for storing maintenance information, geographic information about a service area and the other necessary information in addition to a central processing unit (CPU) 11 and a memory device 12 for storing its program. In addition, the centralized management apparatus 10 comprises a display device 14 such as a CRT (Cathode Ray Tube) and a printing device 15 such as a printer.

The centralized management apparatus 10 finds, for example, the scheduled date of the maintenance work on the basis of the maintenance information which is transmitted from each of the copying machines 1, and displays the date on the display device 14 and prints the date by the printing device 15. The scheduled date of the maintenance work is found in the following manner.

In the memory device 13, areas respectively storing the number of copies per day K actually made by each of the copying machines 1, the average number of copies per day AK, the scheduled total number of copies made from the time when the maintenance work is performed until the succeeding maintenance work is performed TKO, the total number of copies made from the time when the maintenance work is performed up to the present time TK, and the scheduled date of the succeeding maintenance work D are provided for each copying machine (for each customer number ID), as shown in FIG. 2.

The number of copies per day K is transmitted every day from each of the copying machines 1. The average number of copies per day AK is found on the basis of the number of copies which is transmitted from the copying machine 1, and is updated every day. The scheduled total number of copies made from the time when the maintenance work is performed until the succeeding maintenance work is performed TKO is previously set and stored in the memory device 13. The total number of copies made from the time when the maintenance work is performed up to the present time TK is found on the basis of the number of copies which is transmitted from the copying machine 1, and is updated every day. The scheduled date of the succeeding maintenance work D is found in the following manner, and is updated every day.

First, the number of days X between the scheduled date of the succeeding maintenance work D and the present date is found by the following equation (1):

$$X=(TKO-TK)/AK \quad (1)$$

A date after an elapse of the number of days X from the present date is found, and the date is taken as the scheduled date of the succeeding maintenance work D.

For example, it is assumed that the present date is April 10, the scheduled total number of copies made from the time when the maintenance work is performed until the succeeding maintenance work is performed TKO is 35000, the average number of copies per day AK is 100, and the total number of copies made from the time when the maintenance work is performed up to the present time TK is 34000. In this case, the number of days X between the scheduled date of the succeeding maintenance work D and the present date is $(35000-34000)/100=10$, and the scheduled date of the succeeding maintenance work D is April 20.

Information about the place where each of the copying machines 1 is installed may be previously stored to automatically operate a route for efficiently visiting respective copying machines in a group of copying machines which are scheduled to be maintained on dates close to each other on the basis of the information about the place and the scheduled date of the succeeding maintenance work of each of the copying machines 1 which is found in the above described manner and display or print the route. In this case, a road actually utilized may be considered so that the total distance of the route is the minimum distance. In addition, traffic information may be considered in this case to calculate a route which is high in time efficiency. Furthermore, the emergency of the maintenance work may be considered in this case so that such a route that the maintenance work which is particularly urgent is given. priority is obtained.

Additionally, a service man, the number of necessary persons, and the like which are suitable for the type of copying machine or the type of maintenance work may be previously registered for each type of copying machine or for each type of maintenance work to automatically display or print a service man, the number of necessary persons, and the like which are suitable for a copying machine to be maintained.

Description is now made of one example of a method of automatically operating a route for efficiently visiting respective copying machines in a group of copying machines (a group of customers) which are scheduled to be maintained on the same date and displaying or printing the route.

The place where a service man for performing the maintenance work of copying machines waits is taken as a service center. In addition, an area where the maintenance work is performed by the service center is taken as a service area.

Figure 4:
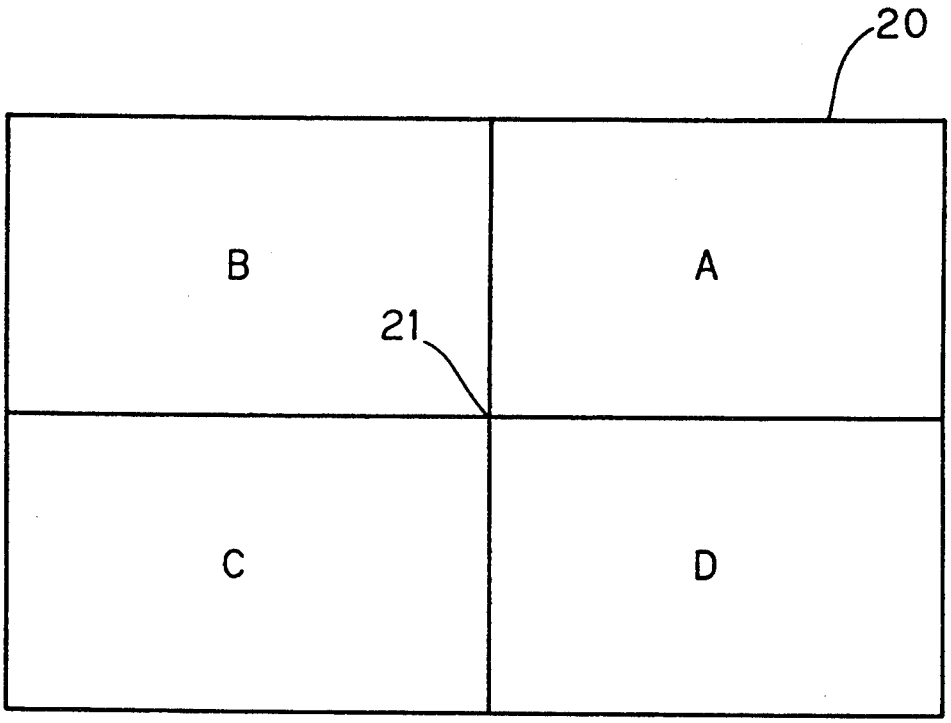
FIGS. 4(*a*) and 4(*b*) are schematic diagrams showing a service area.
Figure 4:
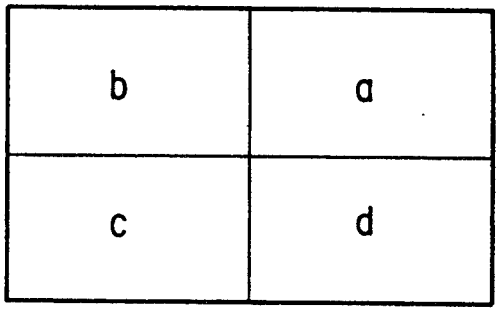

As shown in FIG. 4 (*a*), a service area 20 is set to a rectangular area centered around a service center 21. The service area 20 is divided into four large blocks A, B, C and D of the same size. The large block A, the large block B, the large block C, and the large block D are respectively referred to as a first large block, a second large block, a third large block, and a fourth large block. In addition, each of the large blocks A, B, C and D is divided into four small blocks a, b, c and d of the same size, as shown in FIG. 4 (*b*).

Small number plates given numbers 1 to 10 indicating the order which is suitable for the visit to all the small blocks are previously assigned imaginarily to the 10 small blocks, as shown in FIG. 5. A first large number plate is constituted by the small number plates numbered 1 to 4, a second large number plate is constituted by the small number plates numbered 5 to 8, a third large number plate is constituted by the small number plates numbered 9 to 12, and a fourth large number plate is constituted by the small number plates numbered 13 to 16.

It is assumed that there are a lot of customers in the service area 20, and one copying machine is installed in each of the customers. The respective copying machines are managed by one centralized management apparatus 10.

The memory device 13 stores customer information about maintenance work, as shown in FIG. 3. The customer information about maintenance work is prepared for each customer and in the order of scheduled dates of the maintenance work. Each of the customer information about maintenance work comprises a scheduled date of the maintenance work D which is found in the above described manner, a customer number ID, and an area code EC indicating the place where a customer exists. As the area code EC, a code for designating a small block including the position of a customer is used. For example, an area code A (a) corresponding to a customer given the customer number ID "4" indicates that a customer exists in the small block a in the large block A.

In this example, the scheduled dates of the maintenance work of copying machines installed in six customers are April 12. Therefore, description is made by taking as an example a case where a route for visiting the six customers for the maintenance work is automatically found.

The customer information about maintenance work in the memory device 13 is first retrieved, to extract area codes corresponding to customers for which the maintenance work is to be performed on a predetermined date, April 12 in this example. In FIG. 6, asterisks are respectively assigned to the extracted six small blocks.

A first rule is then applied. Specifically, when there exists a large block in which there exists no customer for which the maintenance work is to be performed on April 12, that is, a large block with no asterisk out of the four large blocks A, B, C and D, the four large number plates are rotated in the counterclockwise direction so that the first large number plate including the small number plate numbered 1 is assigned to a large block one ahead of the large block with no asterisk in the counterclockwise direction.

In this example, the first large plate, the second large plate, the third large plate, and the fourth large plate are respectively assigned to the second large block the third large block C, the fourth large block D, and the first large block A by applying the first rule.

Thereafter, a second rule is applied. Specifically, the four small number plates in the large number plate given the larger number out of the large number plates adjacent to each other are so rotated that the small number plate given the smallest number out of the small number plates assigned to the small blocks with asterisks out of the four small number plates in the large number plate is positioned in the same column or the same row as that in which the small number plate given the largest number out of the small number plates assigned to the small blocks with asterisks out of the four small number plates in the other large number plate given the smaller number.

In this case, when there exists no asterisk in the large block assigned the large number plate given the larger number, the four small number plates in the large number plate are so rotated that the small number plate given the smallest number in the large number plate is positioned near the center of the service area. This second rule is sequentially applied in ascending order of numbers given to the large number plates.

In this example, the second rule is first applied between the first large number plate and the second large number plate shown in FIG. 7. Specifically, the four small number plates in the second large number plate are so rotated that the small number plate given the smallest number (Number 5) out of the small number plates assigned to the small blocks with asterisks out of the four small number plates in the second large number plate is positioned in the same column as that in which the small number plate given the largest number (Number 3) out of the small number plates assigned to the small blocks with asterisks out of the four small number plates in the first large number plate is positioned. In this example, in the step before applying the second rule, the small number plate (Number 3) in the first large number plate and the small number plate (Number 5) in the second large number plate are positioned in the same column, as shown in FIG. 8, so that the four small number plates in the second large number plate are not rotated.

Figure 9:
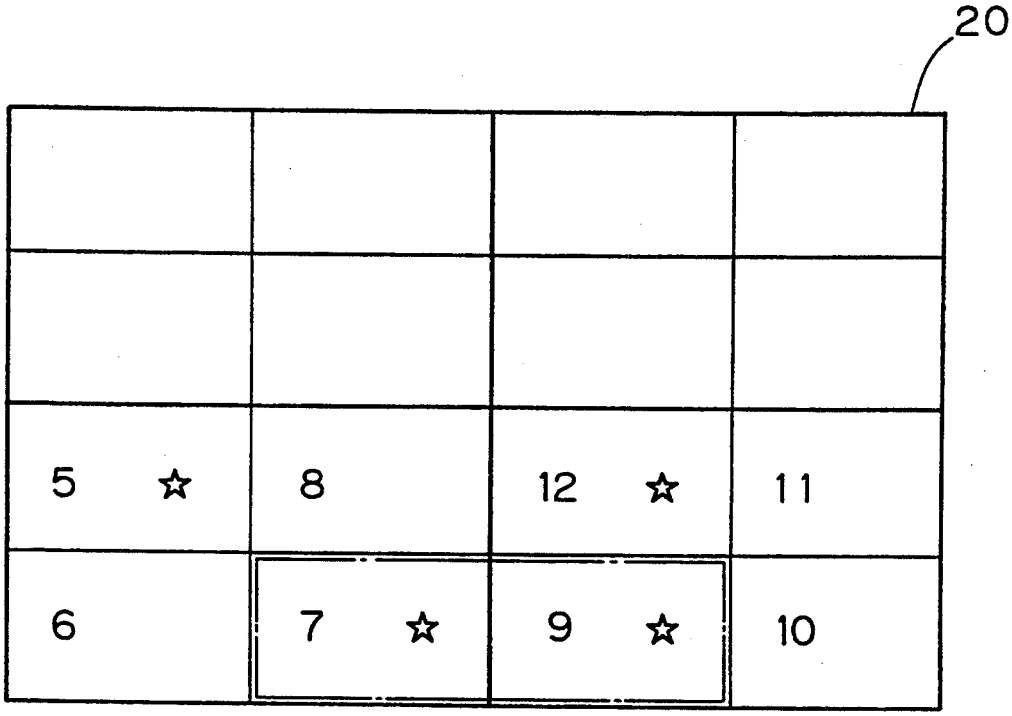
FIG. 9 is a schematic diagram showing the position of small number plates in a third large number plate after applying the second rule between the second large number plate and the third large number plate.

The second rule is then applied between the second large number plate and the third large number plate shown in FIG. 7. Specifically, the four small number plates in the third large number plate are so rotated that the small number plate given the smallest number (Number 9) out of the small number plates assigned to the small blocks with asterisks out of the four small number plates in the third large number plate is positioned in the same row as that in which the small number plate given the largest number (Number 7) out of the small number plates assigned to the small blocks with asterisks out of the four small number plates in the second large number plate is positioned. As a result, the four small number plates in the third large number plate are arranged as shown in FIG. 9.

Figure 10:
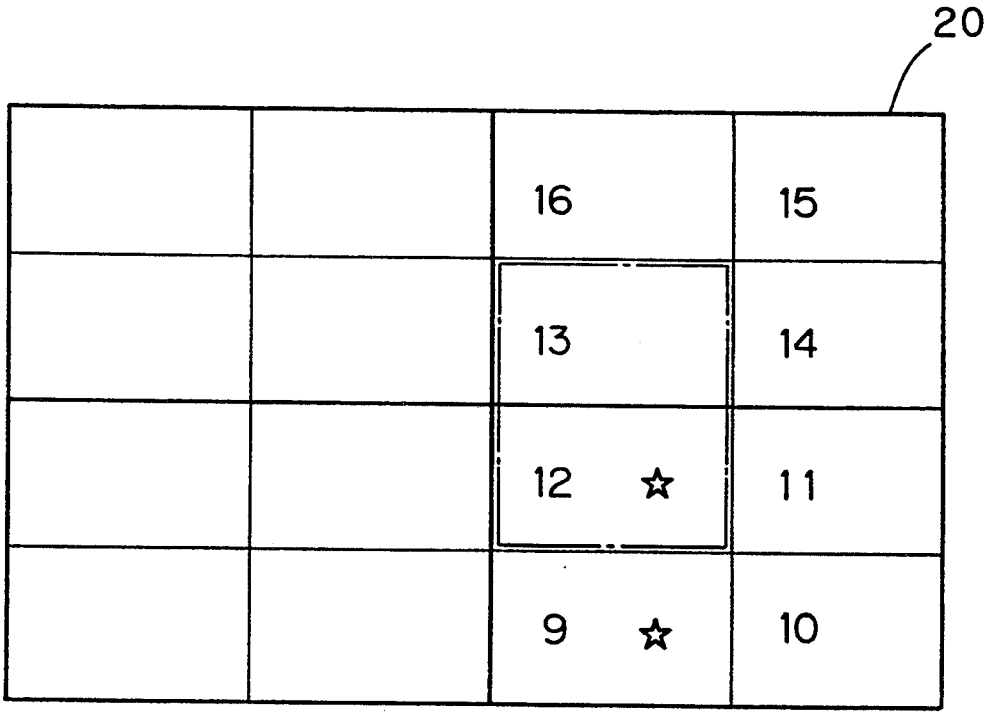
FIG. 10 is a schematic diagram showing the position of small number plates in the third large number plate after applying the second rule between the third large number plate and a fourth large number plate.

The second rule is then applied between the third large number plate and the fourth large number plate shown in FIG. 7. In this case, there exists no asterisk in the large block assigned the fourth large number plate. Accordingly, the four small number plates in the fourth large number plate are so rotated that the small number plate given the smallest number (Number 13) is positioned near the center of the service area 20, as shown in FIG. 10.

Figure 11:
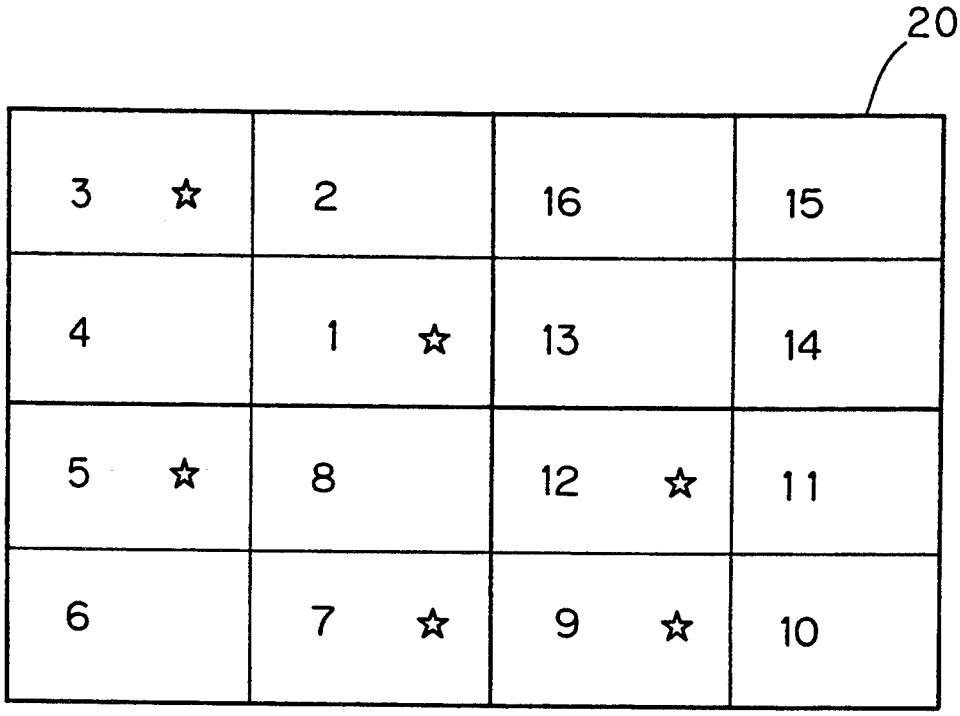
FIG. 11 is a schematic diagram showing the position of all small number plates after applying the first rule and the second rule.
Figure 12:
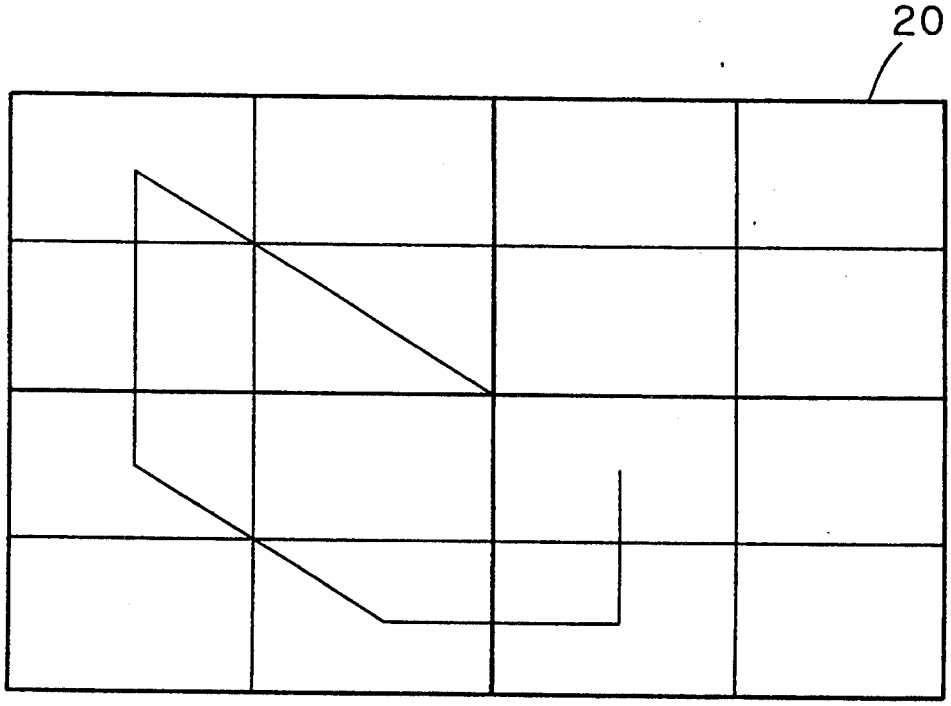
FIG. 12 is a schematic diagram showing the order in which the copying machines are visited for the maintenance work which is found on the basis of FIG. 11.

FIG. 11 shows the position of the small number plates after applying the second rule. Thereafter, the customers for which the maintenance work is to be performed are connected in ascending order of numbers given to the small number plates assigned to the customers, thereby to automatically find a route for the visit, as shown in FIG. 12.

Figure 13:
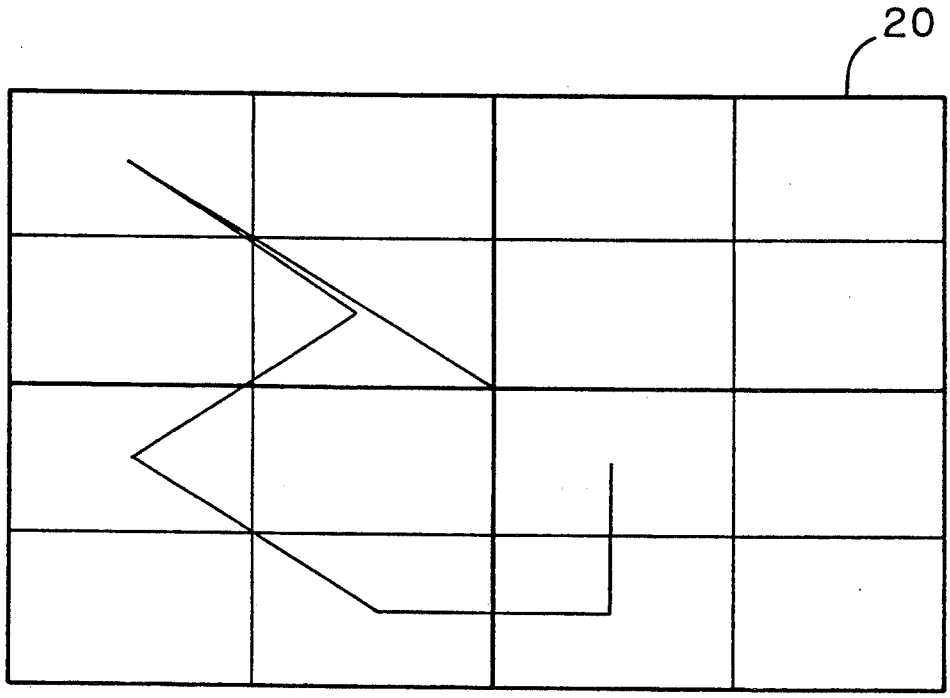
FIG. 13 is a schematic diagram showing the order in which the copying machines are visited for the maintenance work which is arbitrarily found without applying the first rule and the second rule.

As a route for visiting the six customers for which the maintenance work is to be performed as shown in FIG. 6, a route as shown in FIG. 13 is also considered. In such a route, a service man must follow a part of the route twice, so that the route wastes a lot of time and labor. On the other hand, the route for the visit shown in FIG. 12 which is found in the above described manner hardly wastes time and labor.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A management system for image forming apparatus, comprising:

means for transmitting maintenance information about each of a plurality of image forming apparatuses from each of the image forming apparatuses to a centralized management apparatus, and means for calculating scheduled dates for maintenance on the image forming apparatuses, and determining a visitation order for visitation for maintenance of certain image forming apparatuses which have been scheduled for maintenance on a same date or on proximate dates, on the basis of the information about maintenance which is transmitted from the image forming apparatuses to the centralized management apparatus.

2. The management system for image forming apparatuses according to claim 1, wherein the maintenance information is a number of formed images made by each image forming apparatus.

3. The management system for image forming apparatuses according to claim 1, wherein at least one of the image forming apparatuses is a copying machine.

4. The management system for image forming apparatuses in accordance with claim 1, wherein the centralized management system includes:

storing means, provided for each image forming apparatus having a daily average formed image number storage area storing an average number of formed images per day, a scheduled total formed image number storage area storing a scheduled total number of formed images made from a time when past maintenance is performed until succeeding maintenance is to be performed, a total formed image number storage area storing a total number of formed images made from the time when a past maintenance is performed up to a present time;

means for finding, on a basis of a number of formed images made by each image forming apparatus for a predetermined time period which is transmitted from each image forming apparatus for each predetermined time period, the average number of formed images per day made by each image forming apparatus and storing the same in the daily average formed image number storage area;

means for finding, on the basis of the number of formed images made by each image forming apparatus for the predetermined time period which is transmitted from each image forming apparatus for each predetermined time period, the total number of formed images made from the time when past maintenance is performed up to the present time by the image forming apparatus for each image forming apparatus and storing the same in the total formed image number storage area, means for subtracting the total number of formed images stored in the total formed image number storage area from the scheduled total number of formed images which is stored in the scheduled total formed image number storage area for each image forming apparatus, dividing the result of the subtraction by the average number of formed images per day stored in the daily average formed image number storage area to find the difference between the scheduled date of the succeeding maintenance work and the present date, and finding the scheduled date of the succeeding maintenance work on the basis of the difference and the present date for each image forming device, and means for reporting the scheduled date of the succeeding maintenance work found.

5. The management system for image forming apparatuses according to claim 4, wherein the means for reporting the scheduled date of the succeeding maintenance work is a display device.

6. The management system for image forming apparatuses according to claim 4, wherein the means for reporting the scheduled date of the succeeding maintenance work is a printing device.

7. The management system for image forming apparatuses in accordance with claim 1, wherein the number of formed images made by each of the plurality of image forming apparatuses is the number of formed images actually made by each of the image forming apparatuses for a predetermined time period, the number of formed images made by each of the image forming apparatuses for a predetermined time period being transmitted from each of the image forming apparatuses to the centralized management apparatus for each predetermined time period.

8. The management system for image forming apparatuses in accordance with claim 7, wherein the centralized management system includes:

storing means provided for each image forming apparatus having a daily average formed image number storage area storing an average number of formed images per day, a scheduled total formed image number storage area storing a scheduled total number of formed images made from a time when past maintenance is performed until succeeding maintenance is to be performed, a total formed image number storage are storing a total number of formed images made from the time when past maintenance is performed up to a present time;

means for finding, on a basis of a number of formed images made by each image forming apparatus for the predetermined time period which is transmitted from each image forming apparatus for each predetermined time period, the average number of formed images per day made by each image forming apparatus and storing the same in the daily average formed image number storage area;

means for finding, on the basis of the number of formed images made by each image forming apparatus for the predetermined time period which is transmitted from each image forming apparatus for each predetermined time period, the total number of formed images made from the time when past maintenance is performed up to the present time by the image forming apparatus for each image forming apparatus and storing the same in the total formed image number storage area, means for subtracting the total number of formed images stored in the total formed image number storage area from the scheduled total number of formed images which is stored in the scheduled total formed image number storage area for each image forming apparatus, dividing the result of the subtraction by the average number of formed images per day stored in the daily average formed image number storage area to find the difference between the scheduled data of the succeeding maintenance work and the present date, and finding the scheduled date of the succeeding maintenance work on the basis of the difference and the present date for each image forming device, and means for reporting the scheduled date of the succeeding maintenance work found.

9. The management system for image forming apparatuses according to claim 8, wherein the means for reporting the scheduled date of the succeeding maintenance work is a display device.

10. The management system for image forming apparatuses according to claim 8, wherein the means for reporting the scheduled date of the succeeding maintenance work is a printing device.

11. A management system for image forming apparatuses comprising:

means for transmitting a number of copies made by each of a plurality of copying machines from each of the copying machines to a centralized management apparatus through transmitting means; and means for calculating scheduled dates for maintenance on each copying machine and determining a visitation order for visitation for maintenance of certain copying machines which have been scheduled for maintenance on a same date or on proximate dates, on the basis of the number of copies which is transmitted from each of the copying machines to the centralized management apparatus.

12. A management system for image forming apparatuses comprising:

means for transmitting a number of copies made by each of a plurality of copying machines from each of the copying machines to a centralized management apparatus through transmitting means; and means for calculating, on the basis of the number of copies transmitted from each of the copying machines to the centralized management apparatus, a scheduled date of maintenance of each of the copying machines.

13. The management system for image forming apparatuses according to claim 12, wherein the number of copies for a predetermined time period actually made by each of the copying machines is transmitted from each of the copying machines to the centralized management apparatus for each predetermined time period.

14. The management system for image forming apparatuses according to claim 13, wherein the centralized management apparatus includes storing means provided for each copying machine having a daily average copy number storage area storing an average number of copies per day, a scheduled total copy number storage area storing a scheduled total number of copies made from a time when past maintenance is performed until succeeding maintenance is performed, a total formed copy number storage area storing a total number of copies made from the time when past maintenance is performed up to a present time;

means for finding, on the basis of the number of copies for the predetermined time period which is transmitted from the copying machine for each predetermined time period, the total number of copies made from the time when the maintenance work is performed up to the present time by each copying machine and storing the same in the total copy number storage area, means for subtracting the total number of copies which is stored in the total copy number storage area from the scheduled total number of copies which is stored in the scheduled total copy number storage area for the copying machine, dividing the result of the subtraction by the average number of copies per day which is stored in the daily average copy number storage area to find the difference work and the present date, and finding the scheduled date of the succeeding maintenance work on the basis of the difference and the present date for each copying machine, and means for reporting the scheduled date of the succeeding maintenance work found.

15. The management system for image forming apparatuses according to claim 14, wherein the means for reporting the scheduled date of the succeeding maintenance work is a display device.

16. The management system for image forming apparatuses according to claim 14, wherein the means for reporting the scheduled date of the succeeding maintenance work is a printing device.

* * * * *